US009041619B2

(12) United States Patent
McMilin et al.

(10) Patent No.: US 9,041,619 B2
(45) Date of Patent: May 26, 2015

(54) ANTENNA WITH VARIABLE DISTRIBUTED CAPACITANCE

(75) Inventors: Emily B. McMilin, Mountain View, CA (US); Qingxiang Li, Mountain View, CA (US); Robert W. Schlub, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 359 days.

(21) Appl. No.: 13/452,585

(22) Filed: Apr. 20, 2012

(65) Prior Publication Data

US 2013/0278480 A1 Oct. 24, 2013

(51) Int. Cl.

| | |
|---|---|
| ***H01Q 1/00*** | (2006.01) |
| ***H01Q 1/24*** | (2006.01) |
| ***H01Q 9/04*** | (2006.01) |

(52) U.S. Cl.

CPC ..... *H01Q 1/243* (2013.01); *H01Q 9/0457* (2013.01); *H01Q 5/314* (2015.01)

(58) Field of Classification Search

CPC ..... H01Q 1/00; H01Q 1/38
USPC ..... 343/904, 700 MS, 814–817
See application file for complete search history.

(56) References Cited

U.S. PATENT DOCUMENTS

| | | | | |
|---|---|---|---|---|
| 3,742,508 | A | 6/1973 | Tomaszewski | |
| 3,852,670 | A * | 12/1974 | Ma | 455/195.1 |
| 4,145,659 | A | 3/1979 | Wolfram | |
| 6,600,451 | B2 | 7/2003 | Mimura et al. | |
| 6,791,435 | B2 * | 9/2004 | Shingaki et al. | 333/175 |
| 8,035,162 | B2 | 10/2011 | Woo et al. | |
| 8,610,635 | B2 * | 12/2013 | Huang et al. | 343/821 |
| 2007/0182638 | A1 | 8/2007 | Rowell | |
| 2010/0220029 | A1 * | 9/2010 | Cohen | 343/848 |
| 2010/0225554 | A1 * | 9/2010 | Huang et al. | 343/821 |

FOREIGN PATENT DOCUMENTS

| | | |
|---|---|---|
| CN | 1260071 | 7/2000 |
| CN | 102315513 | 1/2012 |
| EP | 2328229 | 6/2011 |
| JP | 2009182793 | 8/2009 |
| KR | 1020100113861 | 10/2010 |
| WO | 9903168 | 1/1999 |
| WO | 0211236 | 2/2002 |

OTHER PUBLICATIONS

McMilin et al., U.S. Appl. No. 13/399,800, filed Feb. 17, 2012.

* cited by examiner

*Primary Examiner* — Huedung Mancuso
(74) *Attorney, Agent, or Firm* — Treyz Law Group; G. Victor Treyz; Michael H. Lyons

(57) ABSTRACT

Electronic devices may be provided with antennas. An antenna may be formed from conductive antenna structures that include a frequency-dependent distributed capacitor. The antenna may include an antenna ground and an antenna resonating element that are separated by a gap. A low pass filter circuit may bridge the gap. The antenna resonating element may have antenna resonating element conductive structures that serve as first and second electrodes for the distributed capacitor. The second electrode may have first and second conductive elements coupled by a filter. The filter may be a low pass filter implemented using an inductor. The inductor may have a first terminal coupled to the first conductive element and a second terminal coupled to the second conductive element. A first antenna feed terminal may be coupled to the first conductive element and a second antenna feed terminal may be coupled to the antenna ground.

19 Claims, 14 Drawing Sheets

ANTENNA WITH VARIABLE DISTRIBUTED CAPACITANCE

BACKGROUND

This relates generally to electronic devices, and more particularly, to antennas for electronic devices.

Electronic devices such as portable computers and cellular telephones are often provided with wireless communications capabilities. For example, electronic devices may use long-range wireless communications circuitry such as cellular telephone circuitry to communicate using cellular telephone bands. Electronic devices may use short-range wireless communications circuitry such as wireless local area network communications circuitry to handle communications with nearby equipment. Electronic devices may also be provided with satellite navigation system receivers and other wireless circuitry.

To satisfy consumer demand for small form factor wireless devices, manufacturers are continually striving to implement wireless communications circuitry such as antenna components using compact structures. At the same time, it may be desirable to include conductive structures in an electronic device such as metal device housing components and electronic components. Because conductive components can affect radio-frequency performance, care must be taken when incorporating antennas into an electronic device that includes conductive structures. For example, care must be taken to ensure that the antennas and wireless circuitry in a device are able to exhibit satisfactory performance over a range of operating frequencies.

It would therefore be desirable to be able to provide wireless electronic devices with improved antenna structures.

SUMMARY

Electronic devices may be provided that contain wireless communications circuitry. The wireless communications circuitry may include radio-frequency transceiver circuitry and antennas.

An electronic device antenna may be formed from conductive antenna structures that include a variable distributed capacitor. The variable distributed capacitor may include a passive filter. The filter may be used to couple conductive structures to each other. Using the filter, the variable distributed capacitor may exhibit a frequency-dependent capacitance. The frequency-dependent capacitance may help match the impedance of the antenna to a desired impedance over a range of operating frequencies.

The antenna may include an antenna ground and an antenna resonating element that are separated by a gap. The antenna resonating element may have antenna resonating element conductive structures that serve as a first electrode of the variable distributed capacitor and may have a first and second conductive elements coupled by a filter that form a second electrode of the capacitor.

The filter may be a low pass filter implemented using an inductor. Low pass filters may also be implemented using multiple components such as capacitors and inductors. The inductor or other low pass filter circuit may have a first terminal coupled to the first conductive element and a second terminal coupled to the second conductive element. A first antenna feed terminal may be coupled to the first conductive element and a second antenna feed terminal may be coupled to the antenna ground.

Further features of the invention, its nature and various advantages will be more apparent from the accompanying drawings and the following detailed description of the preferred embodiments.

DETAILED DESCRIPTION

Figure 1:
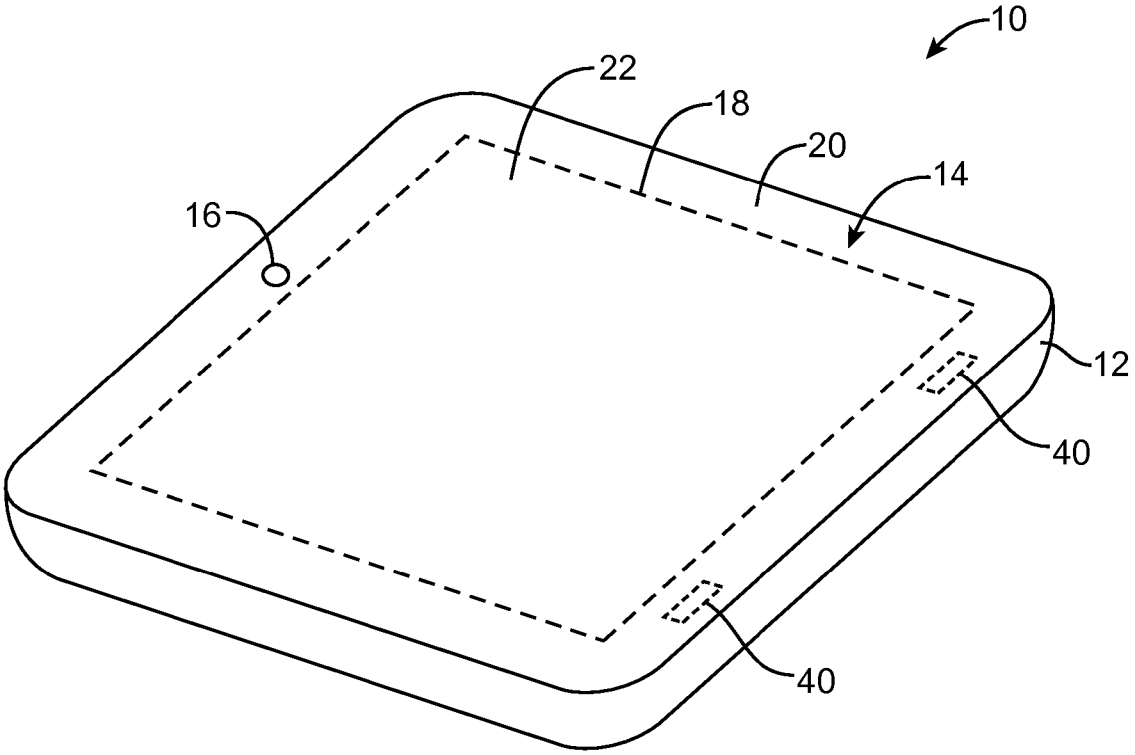
FIG. 1 is a perspective view of an illustrative electronic device with wireless communications circuitry in accordance with an embodiment of the present invention.

Electronic devices such as electronic device 10 of FIG. 1 may be provided with wireless communications circuitry. The wireless communications circuitry may be used to support wireless communications in multiple wireless communications bands. The wireless communications circuitry may include one or more antennas.

The antennas can be formed from conductive structures on printed circuit boards or other dielectric substrates. If desired, conductive structures for the antennas may be formed from conductive electronic device structures such as portions of conductive housing structures. Examples of conductive housing structures that may be used in forming an antenna include conductive internal support structures such as sheet metal structures and other planar conductive members, conductive housing walls, a peripheral conductive housing member such as a display bezel, peripheral conductive housing structures such as conductive housing sidewalls, a conductive planar rear housing wall and other conductive housing walls, or other conductive structures. Conductive structures for antennas may also be formed from parts of electronic components, such as switches, integrated circuits, display module structures, etc. Shielding tape, shielding cans, conductive foam, and other conductive materials within an electronic device may also be used in forming antenna structures.

Antenna structures may be formed from patterned metal foil or other metal structures. If desired, antenna structures may be formed from conductive traces such as metal traces on a substrate. The substrate may be a plastic support structure or other dielectric structure, a rigid printed circuit board substrate such as a fiberglass-filled epoxy substrate (e.g., FR4), a flexible printed circuit ("flex circuit") formed from a sheet of polyimide or other flexible polymer, or other substrate material. If desired, antenna structures may be formed using combinations of these approaches. For example, an antenna may be formed partly from metal traces (e.g., ground conductor) on a plastic support structure and partly from metal traces on a printed circuit (e.g., patterned traces for forming antenna resonating element structures).

The housing for electronic device 10 may be formed from conductive structures (e.g., metal) or may be formed from dielectric structures (e.g., glass, plastic, ceramic, etc.). Antenna windows formed from plastic or other dielectric material may, if desired, be formed in conductive housing structures. An antenna for device 10 may be mounted adjacent to a dielectric housing wall or may be mounted under an antenna window structure so that the antenna window structure overlaps the antenna. During operation, radio-frequency antenna signals may pass through dielectric antenna windows and other dielectric structures in device 10. If desired, device 10 may have a display with a cover layer. Antennas for device 10 may be mounted so that antenna signals pass through the display cover layer.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a cellular telephone, or a media player. Device 10 may also be a television, a set-top box, a desktop computer, a computer monitor into which a computer has been integrated, or other suitable electronic equipment.

Device 10 may have a display such as display 14 that is mounted in a housing such as housing 12. Display 14 may, for example, be a touch screen that incorporates capacitive touch electrodes or may be insensitive to touch. A touch sensor for display 14 may be formed from capacitive touch sensor electrodes, a resistive touch array, touch sensor structures based on acoustic touch, optical touch, or force-based touch technologies, or other suitable touch sensors.

Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A cover layer may cover the surface of display 14. The cover layer may be formed from a transparent glass layer, a clear plastic layer, or other transparent member. As shown in FIG. 1, openings may be formed in the cover layer to accommodate components such as button 16.

Display 14 may have an active portion and, if desired, may have an inactive portion. The active portion of display 14 may contain active image pixels for displaying images to a user of device 10. The inactive portion of display 14 may be free of active pixels. The active portion of display 14 may lie within a region such as central rectangular region 22 (bounded by rectangular outline 18). Inactive portion 20 of display 14 may surround the edges of active region 22 in a rectangular ring shape.

In inactive region 20, the underside of the display cover layer for display 14 may be coated with an opaque masking layer. The opaque masking layer may be formed from an opaque material such as an opaque polymer (e.g., black ink, white ink, a coating of a different color, etc.). The opaque masking layer may be used to block interior device components from view by a user of device 10. The opaque masking layer may, if desired, be sufficiently thin and/or formed from a sufficiently non-conductive material to be radio transparent. This type of configuration may be used in configurations in which antenna structures are formed under inactive region 20. As shown in FIG. 1, for example, antenna structures such as one or more antennas 40 may be mounted in housing 12 so that inactive region 20 overlaps the antenna structures.

Housing 12, which may sometimes be referred to as a case, may be formed of plastic, glass, ceramics, fiber composites, metal (e.g., stainless steel, aluminum, etc.), other suitable materials, or a combination of these materials. In some situations, housing 12 or parts of housing 12 may be formed from dielectric or other low-conductivity material. In other situations, housing 12 or at least some of the structures that make up housing 12 may be formed from metal elements.

In configurations for device 10 in which housing 12 is formed from conductive materials such as metal, antennas 40 may be mounted under the display cover layer for display 14 as shown in FIG. 1 (e.g., under inactive region 20) and/or antennas 40 may be mounted adjacent to one or more dielectric antenna windows in housing 12. During operation, radio-frequency antenna signals can pass through the portion of inactive region 20 of the display cover layer that overlaps antennas 40 and/or radio-frequency antenna signals can pass through other dielectric structures in device 10 such as antenna window structures. In general, antennas 40 may be located in any suitable location in device housing 12 (e.g., along the edges of display 14, in corners of device 10, under an antenna window or other dielectric structure on a rear surface of housing 12, etc.).

Device 10 may have a single antenna or multiple antennas. In configurations in which multiple antennas are present, the antennas may be used to implement an antenna array in which signals for multiple identical data streams (e.g., Code Division Multiple Access data streams) are combined to improve signal quality or may be used to implement a multiple-input-multiple-output (MIMO) antenna scheme that enhances performance by handling multiple independent data streams (e.g., independent Long Term Evolution data streams). Multiple antennas may also be used to implement an antenna diversity scheme in which device 10 activates and inactivates each antenna based on its real time performance (e.g., based on received signal quality measurements). In a device with wireless local area network wireless circuitry, the device may use an array of antennas 40 to transmit and receive wireless local area network signals (e.g., IEEE 802.11n traffic). Multiple antennas may be used together in both transmit and receive modes of operation or may only be used together during only signal reception operations or only signal transmission operations.

Antennas in device 10 may be used to support any communications bands of interest. For example, device 10 may include antenna structures for supporting wireless local area network communications such as IEEE 802.11 communications or Bluetooth® communications, voice and data cellular telephone communications, global positioning system (GPS) communications or other satellite navigation system communications, etc.

Figure 2:
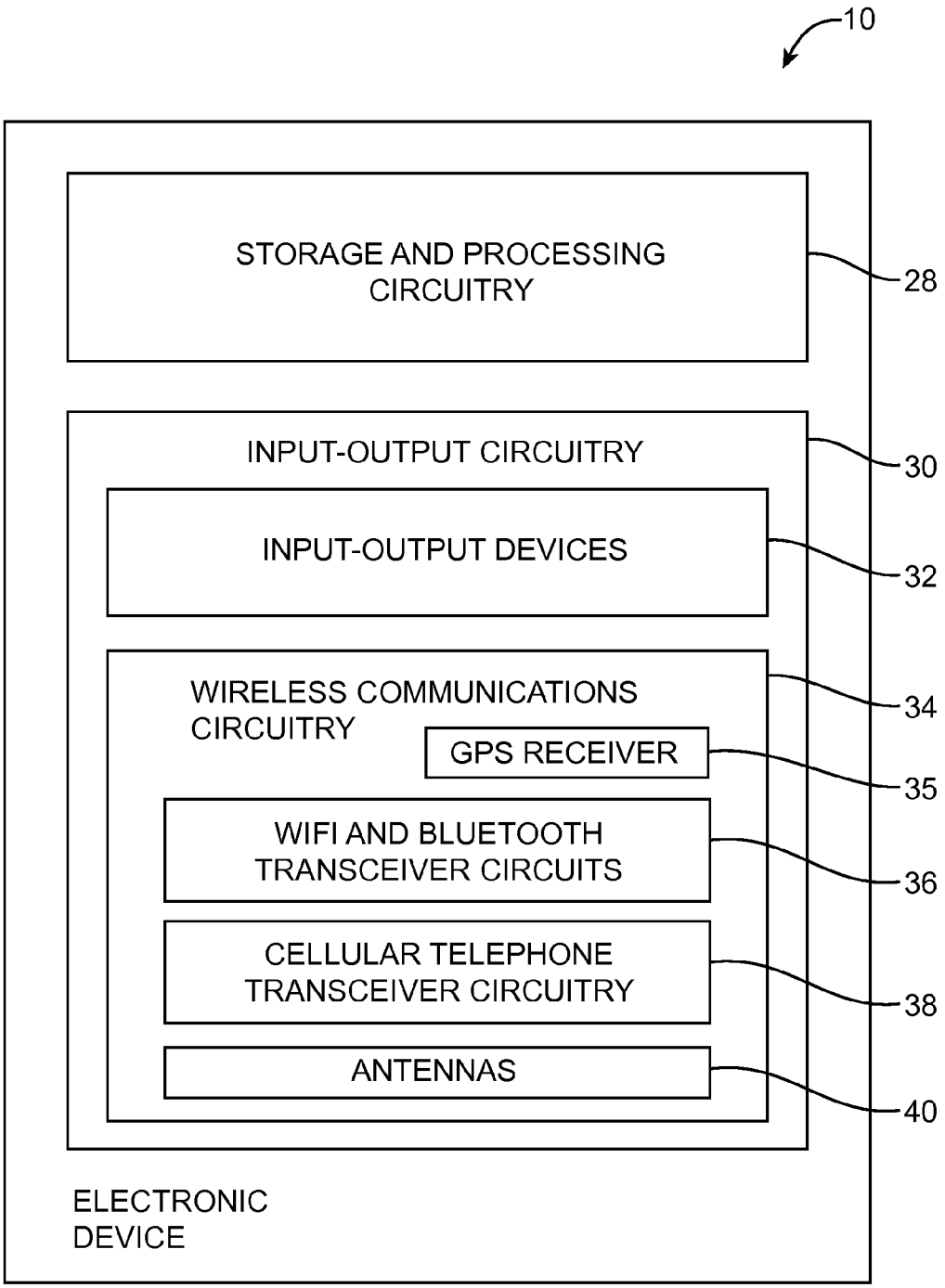
FIG. 2 is a schematic diagram of an illustrative electronic device with wireless communications circuitry in accordance with an embodiment of the present invention.

A schematic diagram of an illustrative configuration that may be used for electronic device 10 is shown in FIG. 2. As shown in FIG. 2, electronic device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 may be used to control the operation of device 10. The processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VOIP) telephone call applications, email applications, media playback applications, operating system functions, etc. To support interactions with external equipment, storage and processing circuitry 28 may be used in implementing communications protocols. Communications protocols that may be implemented using storage and processing circuitry 28 include internet protocols, wireless local area network protocols such as IEEE 802.11 protocols—sometimes referred to as WiFi® and protocols for other short-range wireless communications links such as the Bluetooth® protocol, cellular telephone protocols, etc.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals. Wireless signals can also be sent using light (e.g., using infrared communications).

Wireless communications circuitry 34 may include satellite navigation system receiver circuitry such as Global Positioning System (GPS) receiver circuitry 35 (e.g., for receiving satellite positioning signals at 1575 MHz) or satellite navigation system receiver circuitry associated with other satellite navigation systems. Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands in frequency ranges of about 700 MHz to about 2200 MHz or bands at higher or lower frequencies. Wireless communications circuitry 34 can include circuitry for other short-range and long-range wireless links if desired. For example, wireless communications circuitry 34 may include wireless circuitry for receiving radio and television signals, paging circuits, near field communications circuitry, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include one or more antennas 40. Antennas 40 may, if desired, have distributed capacitor structures. The distributed capacitor structures may have portions that are coupled to each other using one or more passive radio-frequency filters such as low pass filters. Using low pass filter circuitry, the distributed capacitor structures may exhibit a capacitance value that decreases as a function of increasing frequency (i.e., the distributed capacitor structures may be configured to form a frequency-dependent variable distributed capacitor). An antenna such as one of antennas 40 may be provided with a variable distributed capacitor (e.g., to form a series capacitor for an antenna feed for antenna 40). The use of the variable distributed capacitor may help ensure that a transmission line is impedance matched to the antenna over a range of operating frequencies.

Figure 3:
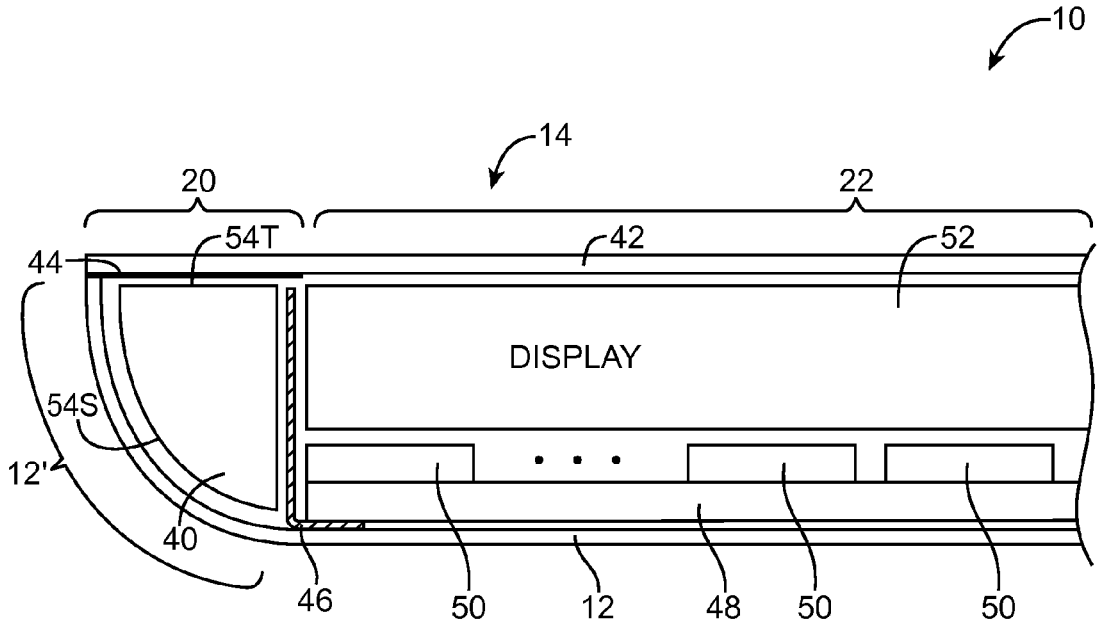
FIG. 3 is a cross-sectional side view of a portion of an electronic device showing how the device may be provided with an antenna in accordance with an embodiment of the present invention.

FIG. 3 is a cross-sectional side view of a portion of device 10. In the illustrative configuration of FIG. 3, antenna 40 has been formed along one of the edges of device housing 12 under inactive portion 20 of display 14. Display structures 52 (e.g., an array of image pixels for displaying images for the user of device 10) may be mounted under display cover layer 42 of display 14 in the center of device housing 12 (i.e., under active region 22 of display 14). In inactive display region 20, the interior surface of display cover layer 42 may be covered with opaque masking material 44 to block internal structures such as antenna 40 from view by a user of device 10. Housing 12 may have a planar rear housing wall. Housing 12 may have vertical sidewalls that run perpendicular to the planar rear housing wall or may, as shown in FIG. 3, have curved sidewalls that extend vertically upwards from the planar rear housing wall.

Device 10 may include one or more substrates such substrate 48 on which electrical components 50 are mounted. Electrical components 50 may include integrated circuits, discrete components such as resistors, inductors, and capacitors, switches, connectors, light-emitting diodes, and other electrical devices for forming circuitry such as storage and processing circuitry 28 and input-output circuitry 30 of FIG. 2.

Substrate 48 may be formed from a dielectric such as plastic. If desired, substrate 48 may be implemented using one or more printed circuits. For example, substrate 48 may be a flexible printed circuit ("flex circuit") formed from a flexible sheet of polyimide or other polymer layer or may be a rigid printed circuit board (e.g., a printed circuit board formed from fiberglass-filled epoxy). Substrate 48 may include conductive interconnect paths such as one or more layers of patterned metal traces for routing signals between components 50, antennas such as antenna 40, and other circuitry in device 10.

Antenna 40 may include patterned conductive structures such as patterned metal traces on a printed circuit or plastic carrier. The conductive structures for antenna 40 may be located on upper surface 54T, on sidewall surfaces such as sidewall surface 54S, or elsewhere in antenna 40. If desired, portions of device 10 such as portions of conductive housing 12, shielding structures such as structures 46 (e.g., conductive tape, conductive foam, etc.), portions of internal conductive components such as display structures 52, components 50, and printed circuit 48 may form conductive antenna structures for antenna 40 (e.g., antenna ground structures).

During operation, antenna 40 may transmit and receive radio-frequency signals. These signals may pass through opaque masking layer 44 and display cover layer 42 in inactive region 20 and/or may pass through dielectric portions of housing 12 such as a dielectric antenna window formed in region 12' of housing 12.

Figure 4:
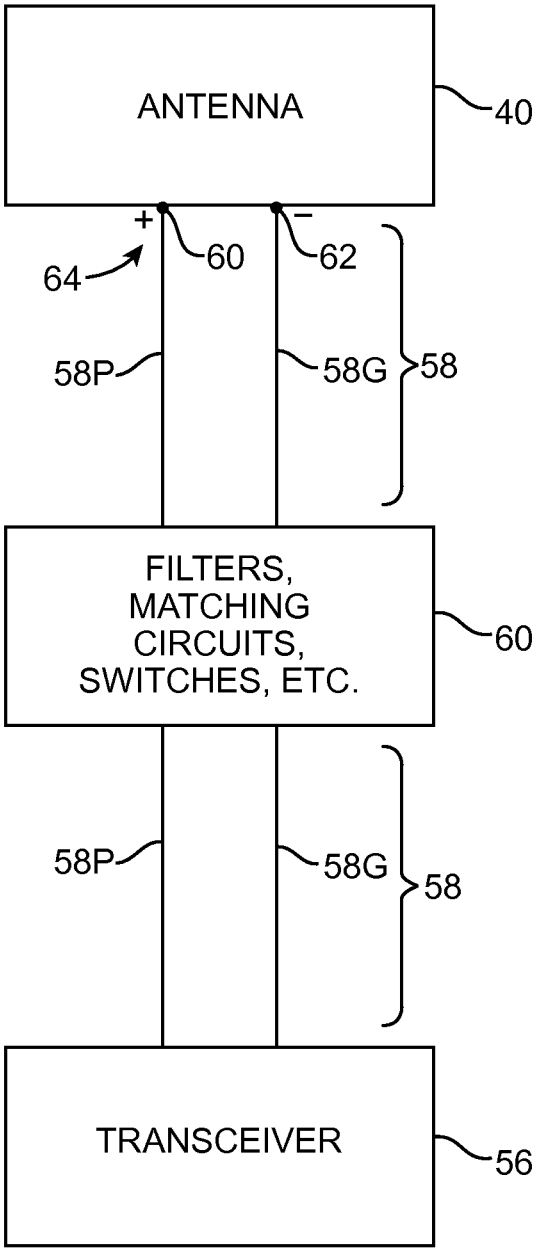
FIG. 4 is a diagram of an illustrative antenna coupled to a radio-frequency transceiver in accordance with an embodiment of the present invention.

FIG. 4 is a diagram showing how antenna 40 may be coupled to radio-frequency transceiver circuitry 56 using transmission line structures such as transmission line path 58. Radio-frequency transceiver circuitry 56 may include transceiver circuits such as satellite navigation system receiver circuitry 35, wireless local area network transceiver circuitry 36, and cellular telephone transceiver circuitry 38. Antenna 40 may have an antenna feed such as antenna feed 64 to which transmission line 58 is coupled. Antenna feed 64 may have a positive antenna feed terminal such as positive antenna feed terminal 60 that is coupled to positive transmission line conductor 58P in transmission line 58. Antenna feed 64 may also have a ground antenna feed terminal such as ground antenna feed terminal 62 that is coupled to ground transmission line conductor 58G in transmission line 58.

Transmission line 58 may be formed from a coaxial cable, a microstrip transmission line structure, a stripline transmission line structure, a transmission line structure formed on a rigid printed circuit board or flexible printed circuit board, a transmission line structure formed from conductive lines on a flexible strip of dielectric material, or other transmission line structures. If desired, one or more electrical components such as components 60 may be interposed within transmission line 58 (i.e., transmission line 58 may have two or more segments). Components 60 may include radio-frequency filter circuitry, impedance matching circuits (e.g., circuits to help match the impedance of antenna 40 to that of transmission line 58), switches, and other circuitry.

In electronic devices such as devices with compact layouts, it can be challenging to satisfy antenna design requirements. The relatively small amount of space that is sometimes available for forming antenna structures may make it desirable to place ground plane structures in close proximity to antenna resonating element structures. The presence of ground structures within close proximity to antenna resonating element structures may, however, tend to reduce antenna bandwidth and make it difficult to achieve desired antenna bandwidth goals.

An antenna design that can be used in device 10 to overcome these challenges may have an antenna feed with a variable distributed capacitor. The presence of the variable distributed capacitor may help impedance match transmission line 58 to antenna 40 over a relatively wide range of frequencies, thereby enhancing antenna performance.

Figure 5:
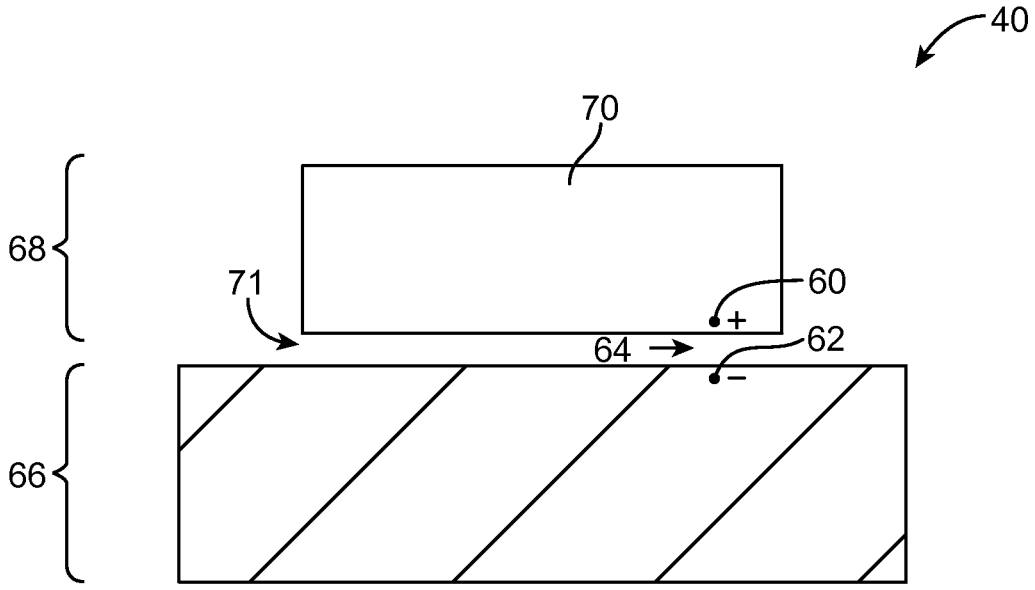
FIG. 5 is a diagram of an illustrative antenna having an antenna resonating element and antenna ground in accordance with an embodiment of the present invention.

FIG. 5 is a diagram of an illustrative antenna. Antenna 40 of FIG. 5 may have antenna resonating element 68 and antenna ground 66. The antenna of FIG. 5 may have an antenna feed such as antenna feed 64 that is formed from positive antenna feed terminal 60 and ground antenna feed terminal 62. In the example of FIG. 5, antenna resonating element 68 has been implemented using resonating element structure 70 (e.g., a rectangular metal trace or a conductive structure having other suitable shapes). Positive antenna feed terminal 60 may be coupled to antenna resonating element structure 70. Ground antenna feed terminal 62 may be formed on an opposing portion of antenna ground structure 66. Antenna resonating element structure 70 and antenna ground structure 66 may be separated by a gap such as gap 71.

Figure 6A:
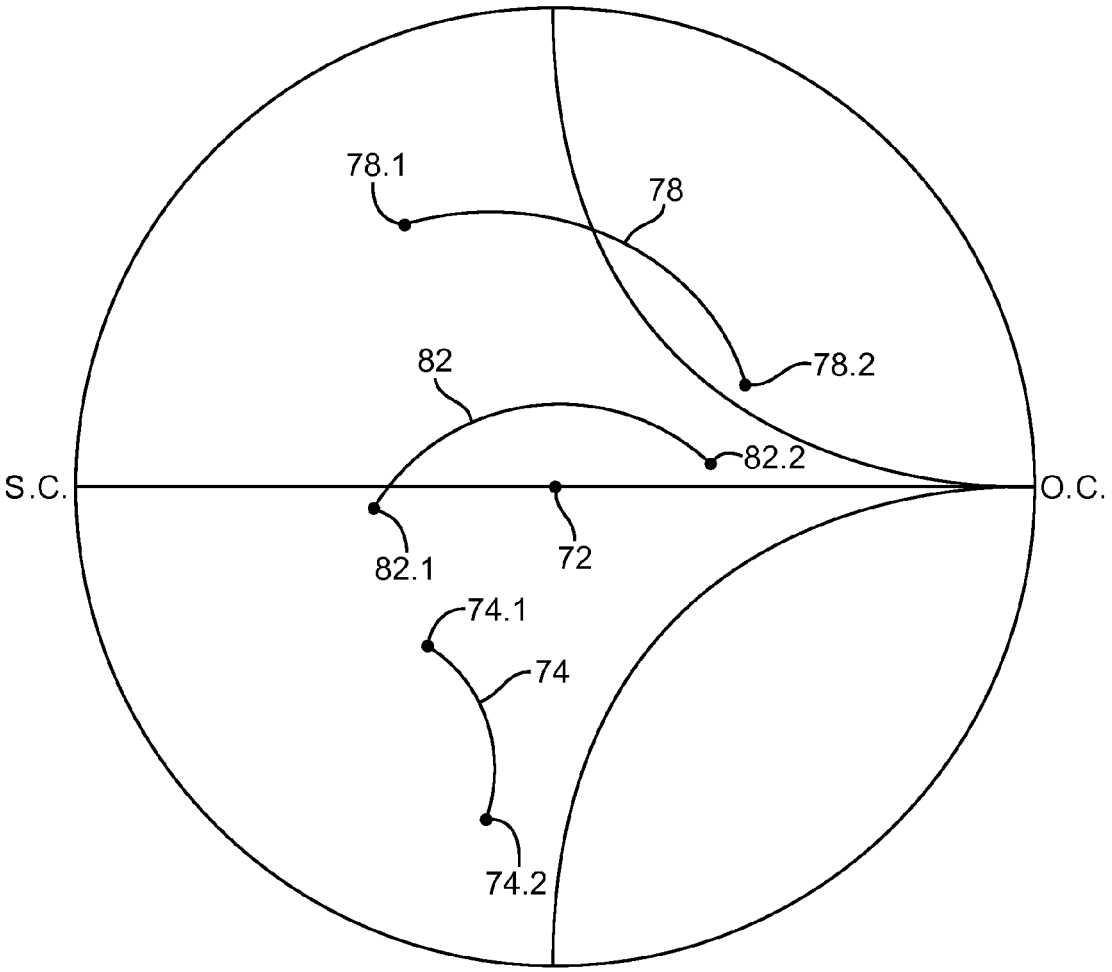
FIGS. 6A and 6B are Smith charts in which antenna performance for an antenna of the type shown in FIG. 5 and other antennas have been plotted in accordance with an embodiment of the present invention.
Figure 6B:
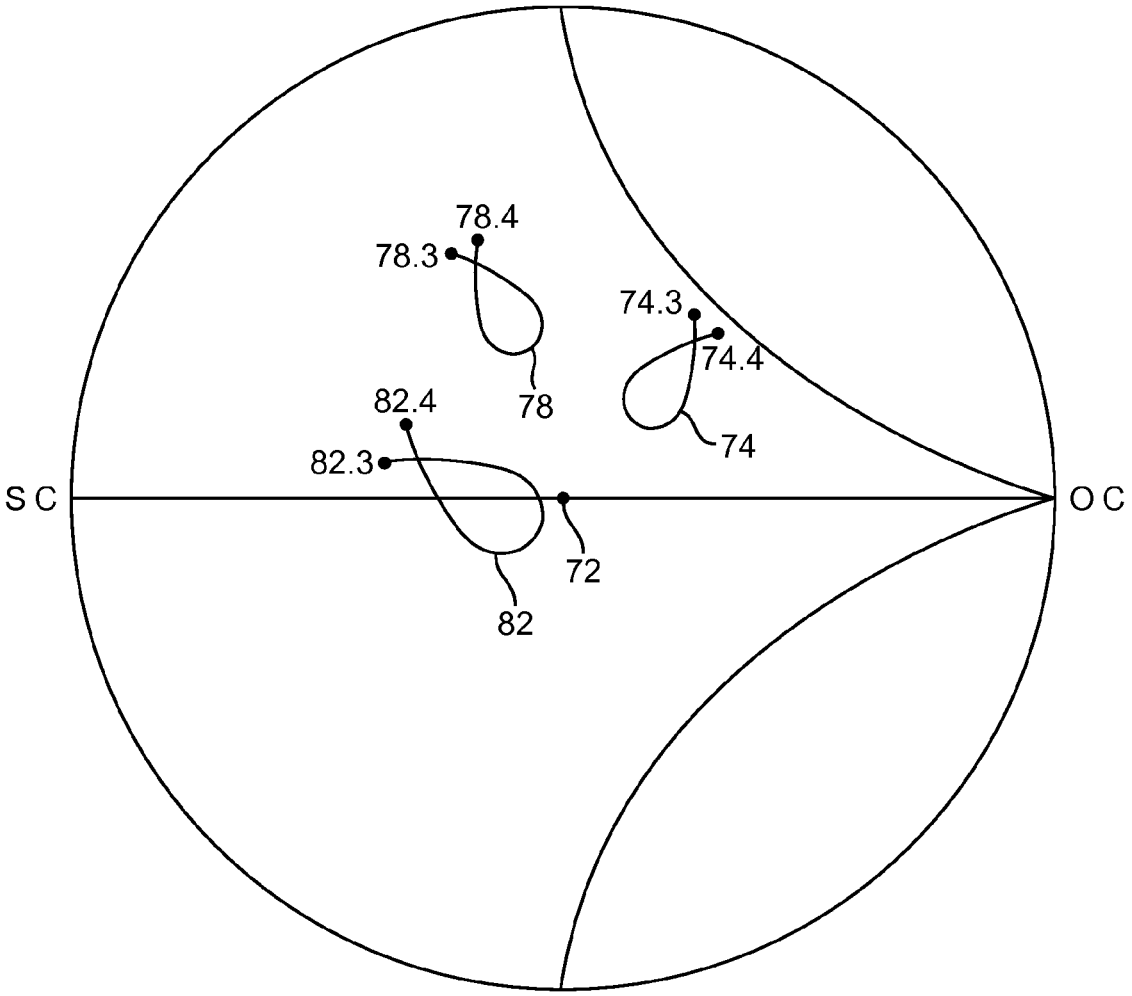

FIGS. 6A and 6B are Smith charts in which antenna impedance has been plotted for the illustrative antenna of FIG. 5 and for antennas with configurations of the types shown in FIGS. 7, 8, 9, and 11. The Smith chart of FIG. 6A contains impedance plots for operation in a first illustrative communications band of interest (e.g., a low band B1 that extends from a first frequency of f1 to a second frequency of f2 and that is centered on a low band frequency of $f_L$). The Smith chart of FIG. 6B contains impedance plots for operation in a second communications band of interest (e.g., a high band B2 that extends from a third frequency of f3 to a fourth frequency of f4 and that is centered on a high band frequency of $f_H$). Antennas for device 10 may operate in other bands, if desired.

Transmission line 58 (FIG. 4) may be characterized by an impedance. The impedance of transmission line 58 may, as an example, be 50 Ohms. For optimum antenna performance, it is desirable to match the impedance of antenna 40 to the impedance of transmission line 58 (i.e., it is desirable to configure antenna 40 so that antenna 40 exhibits an impedance of 50 Ohms to match the 50 Ohm impedance of transmission line 58).

An ideal antenna impedance of 50 Ohms is represented by point 72 in the Smith charts of FIGS. 6A and 6B. In practice, it can be challenging to configure antenna 40 to exhibit the desired 50 Ohm impedance represented by point 72. For example, an antenna of the type shown in FIG. 5 may exhibit a complex impedance such as impedance 74 of FIG. 6 when operating in low band B1. Impedance 74 may be characterized by a first impedance value 74.1 at low band operating frequency f1 (i.e., at the lower end of the low band) and a second impedance value 74.2 at low band operating frequency f2 (i.e., at the upper end of the low band).

As shown in FIG. 6A, impedance 74 (corresponding to a configuration for antenna 40 of the type shown in FIG. 5) may be too capacitive, leading to a non-negligible mismatch between actual antenna impedance 74 and desired antenna impedance 72. Impedance 74 may, for example, be too capacitive in configurations in which antenna 40 is implemented in a restricted volume (e.g., in a compact electronic device having dimensions that are limited relative to a quarter of a wavelength at operating frequencies of interest). To address this mismatch, a shunt inductance such as a thin copper trace or a discrete component such as a shunt inductor or other shunt low pass filter circuit (in which frequencies f1 to f2 lie within the pass band) may be added to antenna 40 that spans gap 71 between antenna resonating element 68 and antenna ground 66.

Figure 7:
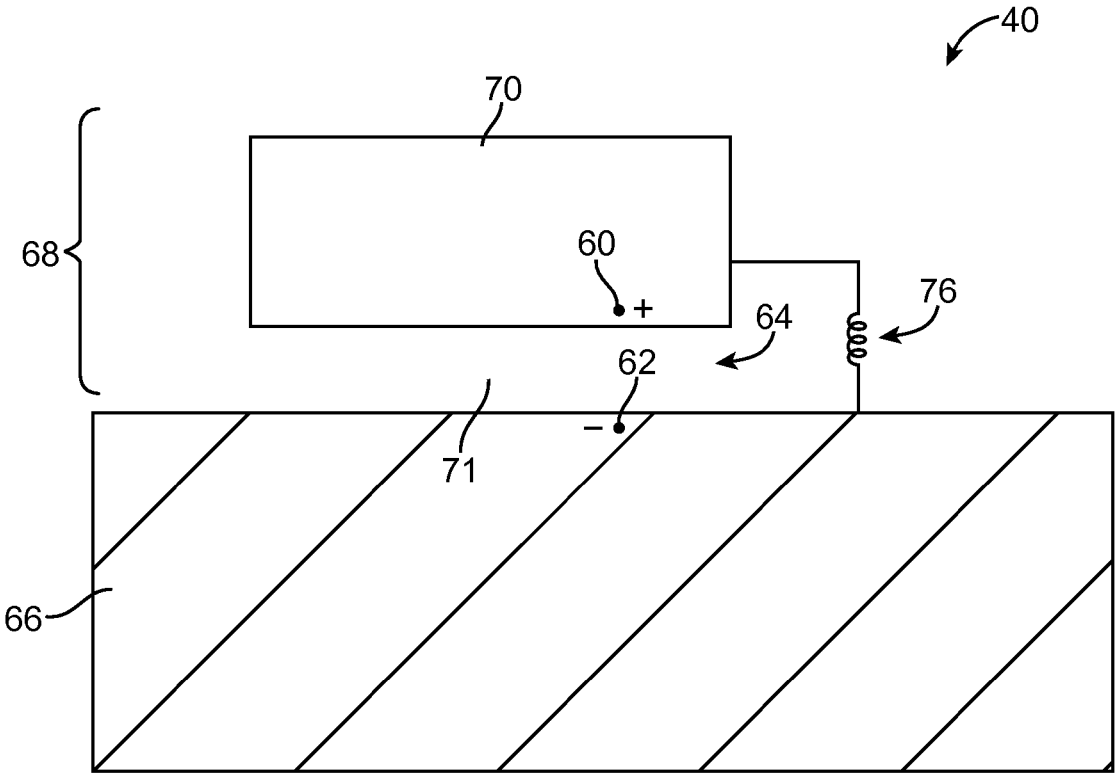
FIG. 7 is a diagram of an illustrative antenna having an antenna resonating element and antenna ground that are coupled by a low pass filter formed from an inductor in accordance with an embodiment of the present invention.

A configuration of the type that may be used for antenna 40 in which a low pass filter such as a shunt inductor has been incorporated into the antenna is shown in FIG. 7. As shown in FIG. 7, antenna 40 may have a shunt inductance such as low pass filter circuitry (inductor) 76. Low pass filter 76 may have a first terminal that is coupled to resonating element structure 70 and an opposing second terminal that is coupled to antenna ground 66 across gap 71. Low pass filter 76 may be formed from a discrete component such as a surface mount technology (SMT) component, may be formed from metal traces (e.g., a metal line coupled between resonating element structure 70 and antenna ground 66), may be formed from one or more SMT components that are coupled to antenna 40 using metal traces that exhibit an inductance, or may be formed using other filter circuitry. When antenna 40 is modified to incorporate a shunt inductance such as low pass filter 76 of antenna 40 in FIG. 7 (in which frequencies f1 to f2 lie within the pass band), antenna 40 may exhibit an impedance such as impedance 78 of FIG. 6A. Impedance 78 may be characterized by a first impedance value 78.1 at low band operating frequency f1 (i.e., at the lower end of the low band) and a second impedance value 78.2 at low band operating frequency f2 (i.e., at the upper end of the low band). Low pass filter 76 in a shunt configuration may behave more like a short circuit at frequency f1 than at frequency f2 (i.e., impedance 78.1 may be changed more significantly from impedance 74.1 by the presence of low pass filter 76 than impedance 78.2 is changed from impedance 74.2).

Figure 8:
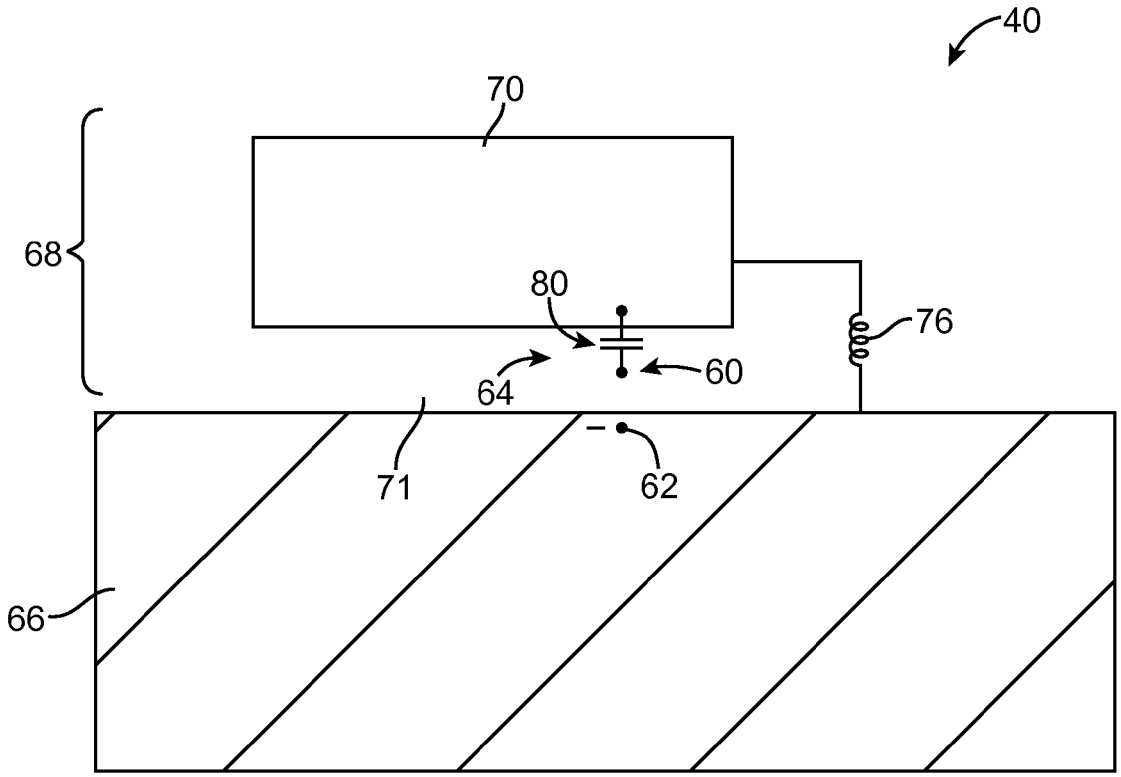
FIG. 8 is a diagram of an illustrative antenna that has an antenna resonating element and antenna ground that are coupled by a low pass filter such as a shunt inductor and that has a feed with a series capacitor in accordance with an embodiment of the present invention.

To counteract the larger movement of impedance 74.1 to 78.1 when incorporating low pass filter 76 into antenna 40, a series capacitor can also be introduced into antenna 40. For example, antenna 40 may be configured as shown in FIG. 8. In the illustrative configuration of FIG. 8, a series capacitance has been interposed in feed 64 of antenna 40 (i.e., series capacitor 80 has been formed between antenna resonating element structure 70 and antenna feed terminal 60). Including a capacitor such as capacitor 80 into the feed of antenna 40 may alter the impedance of antenna 40.

In particular, when antenna 40 is modified to incorporate an inductor such as inductor 76 of antenna 40 in FIG. 7 and an antenna feed such as antenna feed 64 of FIG. 8 that includes a series capacitance such as series capacitor 80, antenna 40 may exhibit an impedance such as impedance 82 of FIG. 6A. Impedance 82 may be characterized by a first impedance value 82.1 at low band operating frequency f1 (i.e., at the lower end of the low band) and a second impedance value 82.2 at low band operating frequency f2 (i.e., at the upper end of the low band). Capacitor 80 of antenna 40 of FIG. 8 may behave more like an open circuit at frequency f1 than at frequency f2. Impedance 82.1 may therefore be changed more significantly from impedance 78.1 by the presence of capacitor 80 than impedance 82.2 is changed from impedance 78.2), as shown in FIG. 6A. The resulting values of impedance for antenna 40 of FIG. 8 (impedance values 82) may be sufficiently close to desired impedance 72 to be satisfactory during operation of antenna 40 in device 10 in low band B1.

High band performance may be understood with reference to the Smith chart of FIG. 6B. When operating in high band B2 (e.g., at operating frequencies ranging from lower high band frequency f3 to upper high band frequency f4), an antenna of the type shown in FIG. 5 may exhibit impedance 74. As shown in FIG. 6B, impedance 74 may be characterized by an impedance value 74.3 at high band operating frequency f3 (i.e., at the lower end of the high band) and impedance value 74.4 at high band operating frequency f4 (i.e., at the upper end of the low band). Impedance 74 may not be too capacitive relative to desired operating impedance 72 during high band operations. Nevertheless, when shunt low pass filter 76 of FIG. 7 (in which frequencies f3 to f4 lie within the stop band) is added to antenna 40 to ensure satisfactory low band performance, high band impedance 74 may change into high band impedance 78. Impedance 78 may be characterized by an impedance value 78.3 at high band operating frequency f3 (i.e., at the lower end of the high band) and impedance value 78.4 at high band operating frequency f4 (i.e., at the upper end of the low band). Because shunt low pass filter 76 behaves more like an open circuit in high band B2 than in low band B1, there ideally would be minimal impact on antenna impedance due to the presence of low pass filter 76. However, due to the presence of thin traces that are generally used when coupling the components of low pass filter 76 between antenna resonating element 70 and ground 66 and due to imperfections in the low pass filter's stop band, low pass filter will appear as a small shunt inductance and there will generally be movement from impedance 74 to impedance 78 in high band B2 when low pass filter 76 is incorporated into antenna 40.

To counteract the movement of impedance 74 to impedance 78 in high band B2 due to the non-zero contribution of shunt inductance from low pass filter 76, series feed capacitor 80 in an antenna of the type shown in FIG. 8 may be implemented using a variable capacitor design that exhibits a decreasing capacitance with increasing frequency of operation. When a variable capacitor is used in implementing capacitor 80 of antenna 40 in an arrangement of the type shown in FIG. 8, antenna 40 may exhibit satisfactory impedance 82 in high band B2. Impedance 82 may be characterized by an impedance value 82.3 at high band operating frequency f3 (i.e., at the lower end of the high band) and impedance value 82.4 at high band operating frequency f4 (i.e., at the upper end of the high band). Because impedance 82 is well matched to desired impedance 72, antenna 40 of FIG. 8 may, when capacitor 80 is implemented using a variable capacitor, exhibit satisfactory operation in high band B2 while simultaneously exhibiting satisfactory operation in low band B1, as described in connection with impedance 82 of FIG. 6A. The variable capacitor for antenna 40 may be implemented using one or more discrete capacitors (e.g., surface mount technology capacitors), a distributed capacitor formed from traces on an antenna substrate such as a plastic support, a flexible printed circuit, a rigid printed circuit board, or other substrate, or a combination of discrete and distributed capacitor structures.

Figure 9:
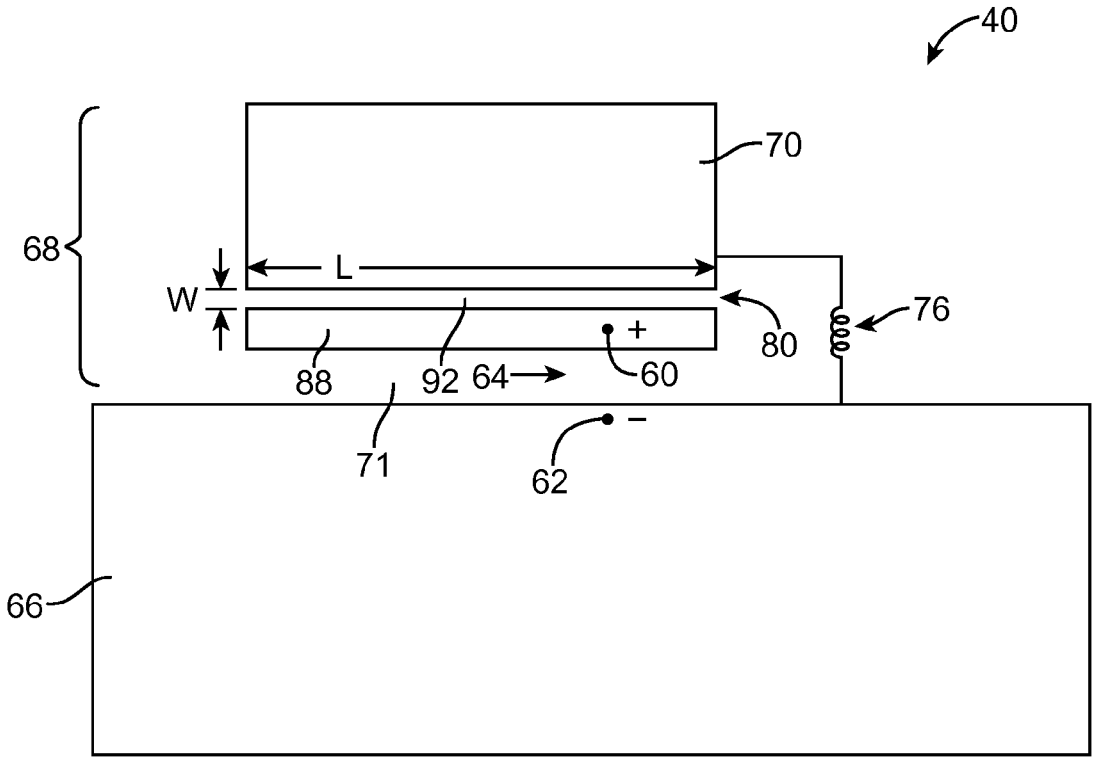
FIG. 9 is a diagram of an illustrative antenna that has an antenna resonating element and antenna ground that are coupled by a shunt inductor and that has a distributed variable capacitor in accordance with an embodiment of the present invention.

FIG. 9 is a diagram of a configuration of the type that may be used when implementing a series feed capacitance for antenna 40 using a fixed distributed capacitor configuration. As shown in FIG. 9, in a distributed capacitor arrangement, the capacitance of capacitor 80 of FIG. 8 may be implemented using a conductive antenna structure such as antenna structure 88 in antenna resonating element 68. Structure 88 may be formed from a metal trace on a substrate such as a plastic carrier or other dielectric support structure, a flexible printed circuit, a rigid printed circuit board, or other substrate. Structure 88 may, for example, be formed from a metal trace. Structures 88 and 70 and, if desired, some or all of ground 66 and structures for forming inductor 76 may be mounted on a common substrate.

Antenna resonating element structure 70 and structure 88 may be separated by a gap such as gap 92. Gap 92 may be characterized by a length L and width W. Structures 88 and 70 may serve as capacitor electrodes that form series capacitance 80 for antenna feed 64. The magnitude of the capacitance exhibited by structures 88 and 70 may be directly proportional to length L and indirectly (inversely) proportional to width W. In the illustrative configuration of FIG. 9, structures 88 and 70 have rectangular shapes and width W of gap 92 is uniform along its length. This is merely illustrative. Structures 88 and 70 may have other shapes (e.g., shapes with bends, shapes with curved edges, shapes with curved and straight edges, or other suitable shapes) and gap 92 may have other shapes (e.g., gap shapes with straight edges, curved edges, combinations of straight and curved edges, shapes characterized by variable widths W, etc.).

As with capacitor 80 of FIG. 8, the capacitance exhibited by distributed capacitor 80 of FIG. 9 may be used to change impedance 78 into impedance 82 in low band B1. Because the distributed capacitance arrangement of FIG. 9 may be used to avoid or reduce reliance on discrete components in antenna 40, the arrangement of FIG. 9 may help reduce the cost and complexity of antenna 40 while helping to improve reliability.

Figure 10A:
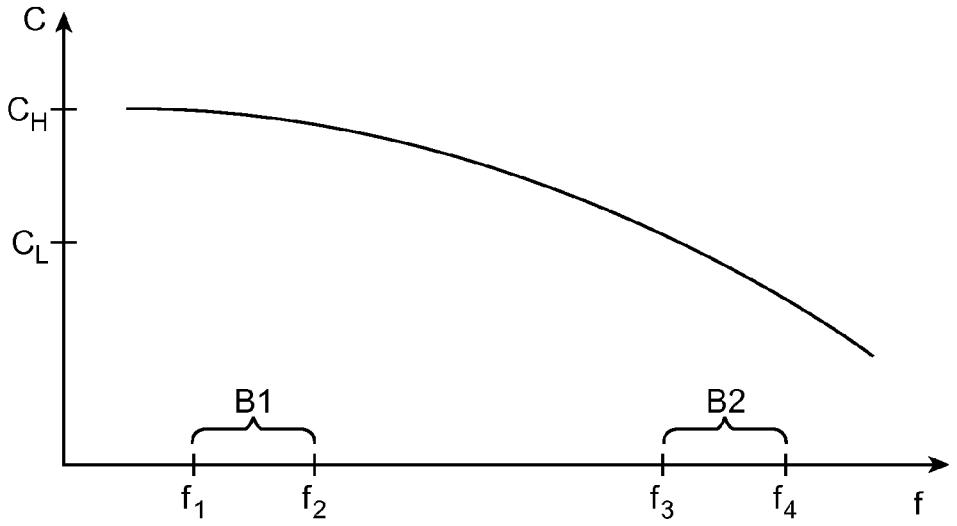
FIG. 10A is a graph showing how a variable capacitor for an antenna may be configured to exhibit a decreasing capacitance value with increasing frequency to improve antenna performance over a range of operating frequencies in accordance with an embodiment of the present invention.
Figure 10B:
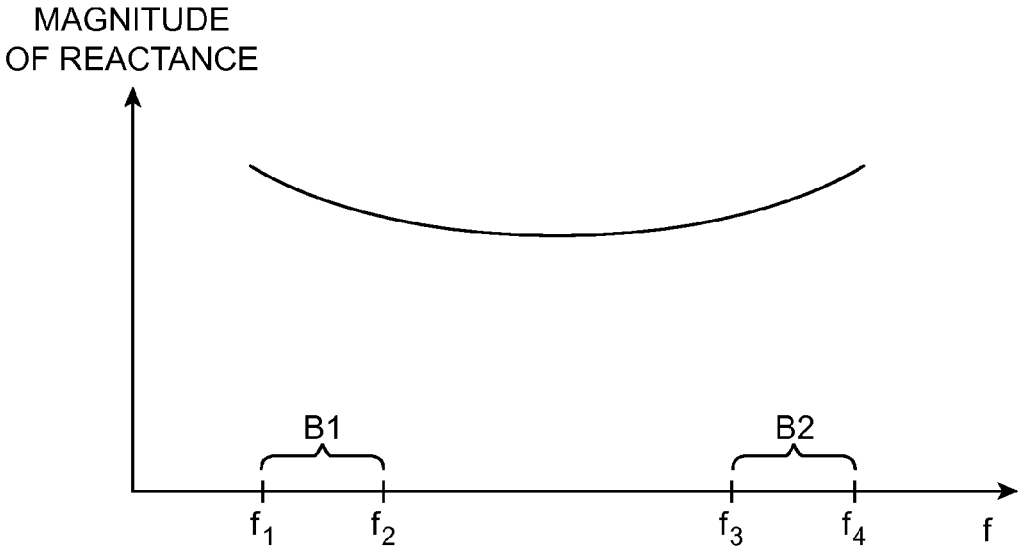
FIG. 10B is a graph showing how a capacitor that has a decreasing capacitance value with increasing frequency of the type shown in FIG. 10A may be characterized by a reactance having a magnitude that is relatively constant as a function of frequency in accordance with an embodiment of the present invention.

The impedance of an antenna with a fixed series capacitance such as antenna 40 of FIG. 9 will tend to vary as a function of frequency, because the reactance X of a fixed capacitor varies inversely with operating frequency, decreasing with increasing frequency. To counteract this decrease in reactance at higher operating frequencies, a variable capacitor design may be used for capacitor 80. For example, a distributed capacitor for antenna 40 may be implemented using a frequency-dependent variable capacitance configuration. With this type of configuration, the capacitance C of the distributed capacitor may decrease as a function of increased operating frequency, as indicated by variable capacitance C in the graph of FIG. 10A. As shown in FIG. 10A, when the variable capacitor is operated at relatively low frequencies such as frequencies in lower communications band B1 centered at lower frequency $f_L$ and extending from lower frequency f1 to upper frequency f2 the capacitor may exhibit a relatively high capacitance value of about $C_H$. When the capacitor is operated at relatively high frequencies such as frequencies in higher communications band B2 centered at higher frequency $f_H$ and extending between lower frequency f3 and upper frequency f4 the capacitor may exhibit a relatively low capacitance value of about $C_L$. The decrease in capacitance C with increasing operating frequency f that is exhibited by the variable capacitance configuration may help ensure that the reactance associated with the capacitor remains relatively constant over a range of operating frequencies (e.g., at both low band B1 and high band B2), as illustrated in FIG. 10B. The relatively constant value of reactance that is exhibited by the variable capacitor configuration of capacitor 80 can be used to help ensure that the impedance of antenna 40 will be well matched to desired impedance 72 over this range of operating frequencies. When incorporating a fixed capacitance value for capacitor 80 into antenna 40, impedance 74 may change to undesirable (mismatched) impedance 78 of FIG. 6B. Impedance 78 of FIG. 6B is not desirable, because impedance 78 is less matched to desired impedance 72 than impedance 74. To match antenna impedance to desired impedance 72 in high band B2, it may be desirable for the reactive contribution from capacitor 80 to not be significantly lower in high band B2 in comparison to the reactive contribution from capacitor 80 in low band B1 that was successfully used in producing matched impedance 82 for low band operations. This can be accomplished by configuring a variable capacitor to exhibit a sufficiently decreasing capacitance at high frequencies to maintain the reactance from capacitor 80 at a relatively similar magnitude during high band and low band operations.

A frequency-dependent variable capacitance configuration for a distributed variable capacitor may be implemented by forming one or more of the electrodes for the distributed from discrete segments that are coupled together using filter circuitry (e.g., passive filter circuitry). An illustrative configuration for antenna 40 in which antenna 40 includes a frequency-dependent distributed variable capacitor (capacitor 80') that is based on a passive filter is shown in FIG. 11.

Figure 11:
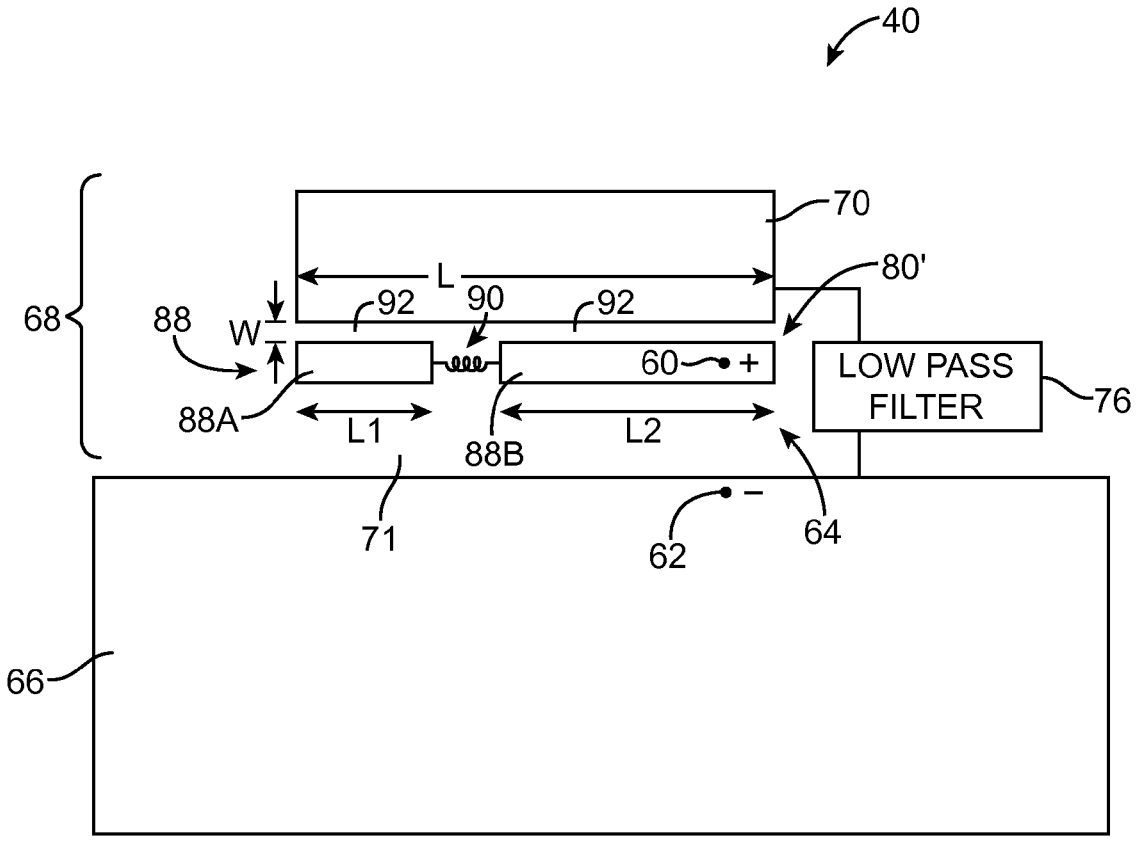
FIG. 11 is a diagram of an illustrative antenna having an antenna resonating element and antenna ground that are coupled by a low pass filter and having a variable distributed capacitor such as a variable distributed capacitor with multiple segments coupled by filter circuitry in accordance with an embodiment of the present invention.

In the arrangement of FIG. 11, capacitor 80' has a first electrode formed from structure 70 and a second electrode (electrode 88). Structure 70 and electrode 88 may form part of antenna resonating element 68 and may be separated from each other by gap 92.

As shown in FIG. 11, distributed capacitor electrode 88 may include multiple individual conductive elements such as conductive electrode element 88A and conductive electrode element 88B. Elements 88A and 88B may be separated from antenna ground 66 by gap 71.

A passive radio-frequency filter such as filter 90 may be interposed between elements 88A and 88B. In the example of FIG. 11, filter 90 has been implemented using a series inductor (i.e., filter 90 is a low pass filter formed from an inductor). One terminal of the inductor may be coupled to element 88A and the other terminal of the inductor may be coupled to element 88B. Other types of filters (e.g., other low pass filter circuits) may be coupled between elements 88A and 88B if desired. The inductor or other components that form filter 90 may be formed from discrete components (e.g., an SMT inductor and/or other SMT components) and/or patterned metal traces.

Conductive element 88A and conductive element 88B may have respective lengths of L1 and L2 (as an example). The magnitude of lengths L1 and L2 may be used to tune the low frequency capacitance and high frequency capacitance exhibited by frequency-dependent variable distributed capacitor 80'.

At lower operating frequencies such as frequencies associated with band B1 of FIG. 10, filter 90 will exhibit a low impedance because the inductor that forms filter 90 will effectively be a short circuit. As a result, conductive elements 88A and 88B will be shorted together and will serve as a single unitary capacitor electrode (i.e., electrode 88 of FIG. 11 will include both element 88A and element 88B). Capacitor electrode 88 in this situation will have a length L (L=L1+L2). The magnitude of capacitance C of capacitor 80' will therefore be inversely proportional to width W of gap 92 and directly proportional to length L (i.e., capacitance C of capacitor 80' will be equal to $C_H$ of FIG. 10 when operated in band B1). Because capacitor 80' is configured to exhibit a capacitance of $C_H$ during low band operations in band B1, antenna 40 of FIG. 11 may exhibit an impedance such as satisfactory low band impedance 82 of FIG. 6A in low band B1.

At higher operating frequencies such as frequencies associated with band B2 of FIG. 10, filter 90 will exhibit a high impedance because the inductor that forms filter 90 will effectively be an open circuit. As a result of the open circuit between conductive elements 88A and 88B, conductive element 88A and 88B will be electrically isolated from each other. In this situation, capacitor electrode 88 will effectively include only conductive element 88B of length L2. Conductive element 88A will be electrically isolated from conductive element 88B and antenna feed terminal 60 on conductive element 88B. The isolation of element 88A prevents element 88A from contributing to the capacitance of capacitor 80'. When operated at higher operating frequencies such as frequencies in band B2 of FIG. 10, capacitor electrode 88 will therefore have a length L2. The magnitude of capacitance C of capacitor 80' will thus be inversely proportional to width W of gap 92 and directly proportional to length L2 (i.e., capacitance C of capacitor 80' will be equal to $C_L$ of FIG. 10 when operated in band B2). Because capacitor 80' is configured to exhibit a capacitance of $C_L$ during high band operations in band B2, antenna 40 of FIG. 11 may exhibit an impedance such as satisfactory high band impedance 82 of FIG. 6B in high band B2.

If desired, the electrodes for frequency-dependent distributed capacitance 80' may be formed from more than two conductive elements and a corresponding number of filters for coupling the elements together. The arrangement in which capacitor electrode 88' has two conductive elements (88A and 88B) coupled using a single filter is merely illustrative. Moreover, the sizes and shapes of the conductive elements that form the capacitor electrodes and resonating element structure 70 may be different than shown in the example of FIG. 11. These elements may, for example, have curved edges, bends, shapes with straight and curved elements and/or bent portions, etc. The filters that are used in coupling the elements together may be formed from inductors and other electrical components and may have different filter characteristics (e.g., different low pass filter cutoff frequencies).

By using a distributed capacitor such as capacitor 80' of FIG. 11 that exhibits a frequency dependent capacitance such as capacitance C of FIG. 10A, antenna 40 may be impedance matched to a desired impedance value (e.g., desired impedance value 72 of FIGS. 6A and 6B) over an expanded range of operating frequencies when compared to an antenna such as antenna 40 of FIG. 9 that has a distributed capacitor that exhibits a fixed capacitance as a function of frequency. As an example, antenna 40 of FIG. 11 may exhibit an impedance such as impedance 82 of FIG. 6A in low band B1 and an impedance such as impedance 82 of FIG. 6B in high band B2. In low band B1, capacitance value $C_H$ may be used to impedance match the impedance of antenna 40 to desired impedance 72 (e.g., by exhibiting impedance 82 of FIG. 6A or other suitable impedance that is close to the value of impedance 72). At higher operating frequencies, such as frequencies in band B2, the reactance of capacitor 80' may be maintained at a value similar to the reactance of capacitor 80' in low band B1 due to the presence of filter 90. Filter 90 is a low pass filter that exhibits a relatively large impedance in band B2, which removes element 88A from electrode 88 and thereby reduces the value of C to $C_L$. Because the reactance of capacitance 80' is inversely proportional to operating frequency (which is higher in band B2 than in band B1) and is inversely proportional to capacitance C (which is lower in band B2 than in band B1), the reactance of capacitance 80' (and therefore the impedance of antenna 40) may be relatively unchanged at band B2 relative to band B1 as shown in FIG. 10B (i.e., antenna 40 may exhibit impedance 82 of FIG. 6B or other suitable impedance that is close to the value of impedance 72 when operating in band B2 in addition to exhibiting impedance 82 when operating in band B1).

Figure 12:
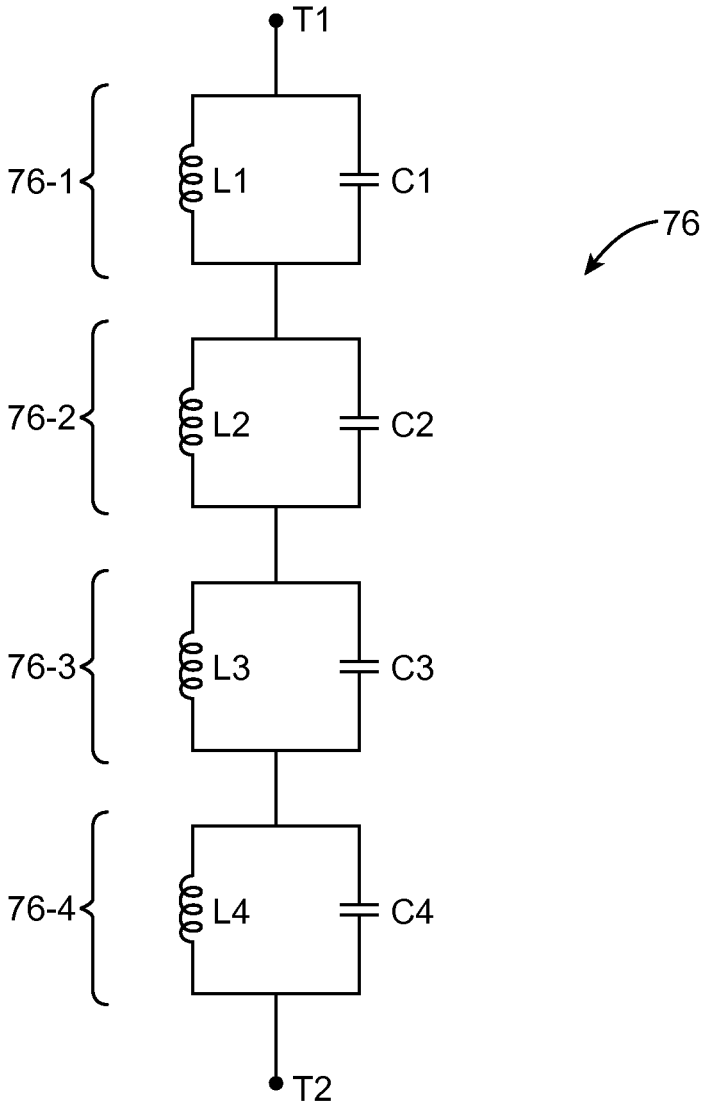
FIG. 12 is a diagram of an illustrative low pass filter formed from stacked band stop filters in accordance with an embodiment of the present invention.

If desired, low pass filter 76 (and, if desired, low pass filters such as low pass filter 90) may be implemented using multiple discrete components. As an example, filter 76 may be formed from multiple band stop filters coupled in series between terminal T1 (i.e., a first terminal that is coupled to resonating element 70) and terminal T2 (i.e., a second terminal that is coupled to ground 66), as shown in FIG. 12. In the example of FIG. 12, low pass filter 76 has been implemented using four band stop filters coupled in series (i.e., band stop filters 76-1, 76-2, 76-3, and 76-4). Other numbers of band stop filters (e.g., fewer than four or more than four) or other types of filter circuits may be used in forming filter 76, if desired.

Figure 13A:
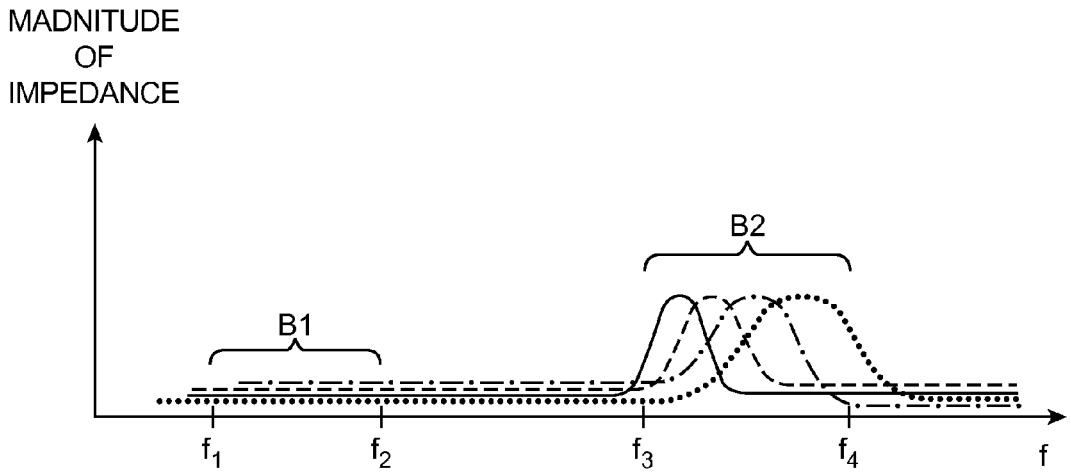
FIG. 13A is a graph showing how the stages in a stacked band stop filter of the type shown in FIG. 12 may be characterized by overlapping stop bands in accordance with an embodiment of the present invention.
Figure 13B:
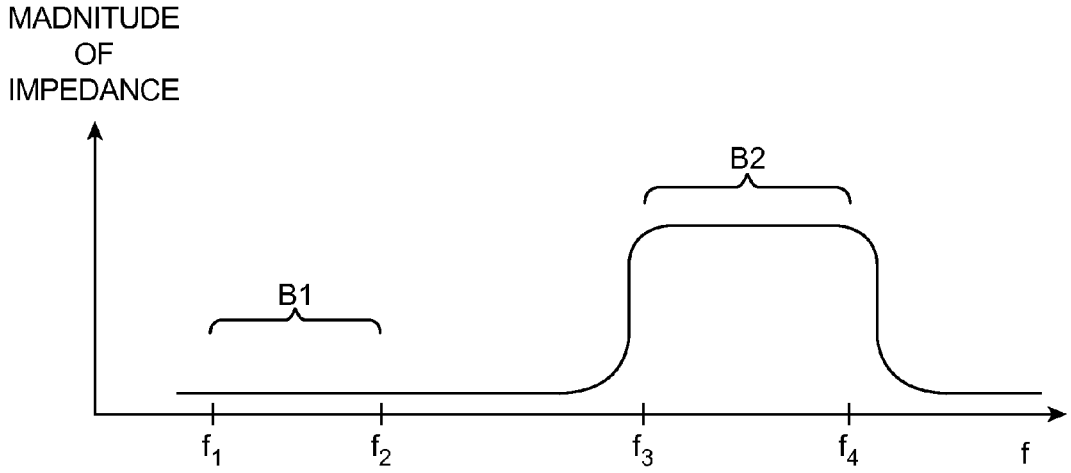
FIG. 13B is a graph showing how the stacked band pass filter circuit of FIG. 12 may be used in implementing a low pass filter over a range of low band and high band operating frequencies in accordance with an embodiment of the present invention.

Each series-connected band stop filter in filter 76 may include a different inductor and capacitor. The values of inductances L1, L2, L3, and L4 and respective capacitances C1, C2, C3, and C4 in FIG. 12 may, for example, be selected to tune the stop bands of each band stop filter stage in filter 76. As shown in FIG. 13A, the individual stages of filter 76 of FIG. 13A may exhibit overlapping resonances at slightly offset frequencies, resulting in low pass filter performance of the type shown in FIG. 13B. The use of band stop filters to implement low pass filter 76 may help improve the performance of low pass filter 76 relative to a design that uses a single inductor by lowering the impedance of filter 76 in low band B1, by raising the impedance of filter 76 in high band B2, and/or by otherwise helping to ensure that the transition between the low and high band impedances closely follows an ideal step function response. Other types of low pass filter may be used for filter 76 or elsewhere in antenna 40 if desired. The use of multiple series-connected band stop filters is merely illustrative.

The foregoing is merely illustrative of the principles of this invention and various modifications can be made by those skilled in the art without departing from the scope and spirit of the invention.

What is claimed is:

1. An antenna for an electronic device, comprising:

an antenna ground; and an antenna resonating element having a distributed capacitor that exhibits a frequency-dependent capacitance, wherein the distributed capacitor has a capacitor electrode formed from first and second conductive elements and a low pass filter coupled between the first and second conductive elements, the antenna resonating element comprising:

a conductive antenna resonating element structure that serves as a first capacitor electrode for the distributed capacitor; and a second capacitor electrode for the distributed capacitor that is formed from the first and second conductive elements.

2. The antenna defined in claim 1 wherein the low pass filter comprises an inductor.

3. The antenna defined in claim 2 further comprising an antenna feed formed from first and second antenna feed terminals, wherein the first antenna feed terminal is coupled to one of the first and second conductive elements and wherein the second antenna feed terminal is coupled to the antenna ground.

4. The antenna defined in claim 1 further comprising an antenna feed having a first antenna feed terminal coupled to the first conductive element and a second antenna feed terminal coupled to the antenna ground.

5. The antenna defined in claim 4 wherein the first and second conductive elements are separated from the conductive antenna resonating element by a first gap and wherein the first and second conductive elements are separated from the antenna ground by a second gap.

6. The antenna defined in claim 5 wherein the low pass filter comprises an inductor having a first terminal coupled to the first conductive element and a second terminal coupled to the second conductive element.

7. The antenna defined in claim 6 further comprising low pass filter circuitry coupled between the conductive antenna resonating element structure and the antenna ground.

8. An antenna for an electronic device, comprising:

a first conductive structure that serves as a first capacitor electrode;

second and third conductive structures that are separated from the first conductive structure by a gap;

a radio-frequency filter coupled between the second and third conductive structures, wherein the second and third conductive structures and the radio-frequency filter are configured to serve as a second capacitor electrode and the first and second capacitor electrodes form a frequency-dependent distributed capacitor; and an antenna feed having first and second antenna feed terminals, wherein the first antenna feed terminal is coupled to the second conductive structure.

9. The antenna defined in claim 8 further comprising an antenna ground, wherein the second antenna feed terminal is coupled to the antenna ground.

10. The antenna defined in claim 9 wherein the radio-frequency filter comprises a low pass filter.

11. The antenna defined in claim 9 wherein the radio-frequency filter comprises an inductor having a first terminal coupled to the second conductive structure and having a second terminal coupled to the third conductive structure.

12. An electronic device antenna, comprising:

an antenna feed having first and second feed terminals;

an antenna ground structure, wherein the first antenna feed terminal is coupled to the antenna ground structure; and an antenna resonating element having a first portion that forms a first capacitor electrode and having a second portion that forms a second capacitor electrode, wherein the second portion of the antenna resonating element includes first and second conductive elements and the first and second conductive elements are interposed between the first capacitor electrode and the antenna ground structure.

13. The electronic device antenna defined in claim 12 further comprising a filter circuit coupled between the first and second conductive elements.

14. The electronic device antenna defined in claim 13 wherein the filter circuit comprises a low pass filter.

15. The electronic device antenna defined in claim 14 wherein the second antenna feed terminal is coupled to the first conductive element.

16. The electronic device defined in claim 15 wherein the second portion of the antenna resonating element is separated from the first portion of the antenna resonating element by a first gap and wherein the second portion of the antenna resonating element is separated from the antenna ground structure by a second gap.

17. The electronic device antenna defined in claim 13 wherein the filter circuit comprises an inductor coupled between the first and second capacitor electrodes.

18. The antenna defined in claim 8, wherein the first, second, and third conductive structures each form part of an antenna resonating element for the antenna.

19. The electronic device antenna defined in claim 12, further comprising:

a band stop filter coupled between the first portion of the antenna resonating element that forms the first capacitor electrode and the antenna ground structure.

* * * * *